United States Patent [19]

Nashiwa et al.

[11] 4,137,104

[45] Jan. 30, 1979

[54] AS-ROLLED STEEL PLATE HAVING IMPROVED LOW TEMPERATURE TOUGHNESS AND PRODUCTION THEREOF

[75] Inventors: Hajime Nashiwa, Sakai; Akiyoshi Mori; Yoshiyasu Kitagawa, both of Wakayama, all of Japan

[73] Assignee: Sumitomo Metal Industries, Ltd., Osaka, Japan

[21] Appl. No.: 768,042

[22] Filed: Feb. 14, 1977

[30] Foreign Application Priority Data

Feb. 23, 1976 [JP] Japan ..... 51-18658

[51] Int. Cl.[2] ..... C22C 38/08

[52] U.S. Cl. ..... 148/36; 75/123 N; 75/123 J; 75/123 K; 75/124; 148/12 F

[58] Field of Search ..... 148/36, 12 F; 75/123 K, 75/123 N, 123 J, 123 L, 124

[56] References Cited

U.S. PATENT DOCUMENTS

| | | | |
|---|---|---|---|
| 3,811,873 | 5/1974 | deBarbadillo | 148/36 |
| 3,834,949 | 9/1974 | Heitmann et al. | 148/36 |

*Primary Examiner*—R. Dean

*Attorney, Agent, or Firm*—Flynn & Frishauf

[57] ABSTRACT

A high strength steel plate of improved low temperature toughness useful for making an arctic grade line pipe is provided with the addition of 0.8 – 2.0% by weight of Ni and 0.0005 – 0.0040% by weight of Ca, which may be used in the as-rolled state and manufactured through two step controlled rolling the secondary step rolling of which is carried out at a temperature lower than a conventional rolling temperature.

7 Claims, No Drawings

AS-ROLLED STEEL PLATE HAVING IMPROVED LOW TEMPERATURE TOUGHNESS AND PRODUCTION THEREOF

BACKGROUND OF THE INVENTION

The present invention relates to a high strength steel plate of improved low temperature toughness, particularly to an as-rolled steel plate useful as an arctic grade line pipe material.

Line pipes may be subjected to temperatures as low as about −70° C in the arctic region. Steel plate to be used for such a purpose, therefore, has to possess the following properties on both their mother or base metal and the heat affected zone after welding.

The mother metal should show greater resistance than ordinary steels to the propagation of brittle fracture at the lowest use temperature, usually around −70° C, i.e. it should show a shear fracture of not less than 85% due to the Battelles Drop Weight Tear Test. It should also have an improved fracture resistance, i.e. not less than 7 kg-m of Charpy V-Notch Shelf Energy, ${}_{v}E_{T}$.

In addition, the heat affected zone should show improved fracture resistant properties at the use temperature above mentioned, and also a V-notch Charpy Shelf Energy not less than 7 kg-m.

In the prior art, line pipes, particularly large diameter line pipes have been manufactured by means of high speed submerged arc welding with a large heat input. Therefore, in order to obtain a Charpy impact value not less than 7.0 kg-m in the heat affected zone, it is required to add a large amount of nickel to the steel composition. However, a steel having such a large amount of nickel intends to precipitate a bainite phase, due to which it is difficult to provide the required properties to steel plates in the as-rolled state.

Under these circumstances, the steel plates widely used for making large diameter line pipe to be laid in the arctic area are 3.5% Ni-steels that have been heat-treated (quenched and tempered). Since this type of steel contains a high content of nickel and it essentially requires a complicated heat-treatment, it inevitably becomes very expensive.

BRIEF DESCRIPTION OF THE INVENTION

Thus, the object of the present invention is to provide a high strength steel plate of improved low temperature toughness.

Another object of the present invention is to provide an inexpensive as-rolled steel plate of a low nickel content, which is to be used instead of conventional 3.5% Ni-steels, and is useful for manufacturing large diameter line pipes and practicable for use even at a temperature of about −70° C.

DETAILED DESCRIPTION OF THE INVENTION

We have found, after long and extensive research and development, that the addition of calcium to a steel composition remarkably improves the impact properties even with respect to a steel containing as low as 1% of nickel. The heat affected zone shows such desirable properties as hereinbefore mentioned even at the lowest use temperature of about −70° C. In addition thereto, the inventors also found that the combination of 0.0005 – 0.0040% of calcium and 0.8 – 2.0% of nickel sufficiently reduces the formation of bainite phase during the low temperature rolling and makes it possible to use the steel plate as a line pipe material in the as-rolled state.

Furthermore, we have found that the combination of such a specified steel composition with a two step rolling in which the secondary rolling is carried out at a lower temperature resulted in a steel plate of further improved low temperature properties.

The present invention, therefore, resides in the as-rolled steel plate having the following chemical composition:

C: 0.03 – 0.55% by weight
Si: 0.02 – 0.50% by weight
Mn: 0.30 – 2.00% by weight
P: not greater than 0.025% by weight
S: not greater than 0.010% by weight
Ni: 0.8 – 2.0% by weight
Ca: 0.0005 – 0.0040% by weight
Nb: 0 – 0.05% by weight
V: 0 – 0.10% by weight
Sol. Al: not greater than 0.080% by weight
Ca/S weight ratio: 0.05 – 1.50
Fe: balance The steel of the present invention shows not only high strength but also improved low temperature toughness, and is used in the as-rolled state without the application of heat-treatment.

According to the present invention, a further improved steel plate is also provided through two step controlled rolling which comprises the steps of: applying a primary rolling step by heating the steel specified hereinbefore to a temperature higher than 1000° C; rough rolling the heated steel to obtain a steel plate of a suitable intermediate thickness; cooling down the rough rolled steel plate to a temperature lower than 650° C; reheating the cooled steel plate to a temperature of 800° – 1000° C; and applying a secondary rolling step by finish rolling the reheated steel plate within the temperature range of 680° – 850° C and with a total reduction in thickness of not less than 30% on the basis of the steel plate thickness when said secondary rolling is started.

Thus, according to the present invention less expensive but improved steel plates have been provided, which can be used in the as-rolled state for making the line pipes to be laid in the arctic region.

One of the features of the present invention steel is that the invention steel shows improved low temperature toughness even with a nickel content of 0.8 – 2.00% by weight. A nickel content of not less than 0.8% is required to improve low temperature toughness. On the other hand, the addition of nickel in a proportion greater than 2.00% will bring about the formation of bainite phase, which causes the low temperature rolling to be impractical, as already described.

The addition of calcium in the present invention steel is effective to prohibit brittle fracturing at a low temperature. A calcium content of not less than 0.0005% is required for that purpose. Since it is difficult from a practical viewpoint to add calcium in a proportion greater than 0.0040% and the effect of the calcium addition will be saturated in such a high proportion, the upper limit of the calcium addition is limited to 0.0040% by weight in the present invention.

Since the effect of the calcium addition is derived from the spheroidization of precipitated sulfides, the sulfur content is limited to less than 0.010% and the ratio of calcium to sulfur in weight is limited to from 0.05 to 1.50. A ratio of calcium to sulfur less than 0.05 does not have any effect on the spheroidization of the sulfides. A ratio greater than 1.50 makes the effect of the calcium addition saturated.

Furthermore, according to the present invention the carbon is added in an amount of 0.03 - 0.55% by weight. A carbon content greater than 0.55% is not desired, since it reduces toughness at a low temperature but a carbon content of less than 0.03% is impractical from an industrial viewpoint, and also it reduces the strength of the steel. Silicon is added until the silicon content is not less than 0.02% for the purpose of deoxidizing a melt of steel, but a silicon content greater than 0.50% will degrade the weldability of the resultant steel. Manganese is added to give a manganese content of not less than 0.30% so as to improve the mechanical strength of the steel, but a manganese content greater than 2.00% brings about the formation of bainite phase, which is undesirable for the present invention purpose. Phosphorus content is limited to not more than 0.025% in order to avoid the formation of bainite phase as well as to avoid contamination of the resultant steel. It is also desirable to keep the sol. Al content not greater than 0.080%. Niobium and vanadium are added so as to further improve the strength of steel plate. However, the addition of niobium in an amount greater than 0.05% by weight will result in the formation of bainite phase and the addition of vanadium in an amount greater than 0.10% by weight results in the reduction in toughness. In the present invention, therefore, the niobium content is limited to from 0 to 0.05% by weight and the vanadium content to from 0 to 0.10% by weight.

In another aspect of the present invention, an improved arctic grade steel plate useful for making line pipes is manufactured through two step controlled rolling, in which the conditions of heating and cooling as well as roll working are limited to as hereinbefore mentioned.

That is, according to the present invention process, after the primary rolling step, the steel plate is cooled to a temperature lower than 650° C. This causes the transformation of the gamma to the alpha austenite phase. When the cooled steel plate is immediately reheated to 800° - 1000° C, above the $Ac_3$, the gamma austenite nucleates and this causes the austenite grains to be distributed very finely and uniformly. The fine grains give improved toughness. A heating temperature lower than 800° C does not result in the austenization of the reheated steel, in which case the rolling work becomes difficult. When the steel plate is reheated at a temperature higher than 1000° C, the formation of coarse grains cannot be avoided, resulting in a reduction in strength and toughness of the final steel plate. The heating temperature is preferably from 900 to 1000° C. The secondary rolling is carried out at a temperature of 680° - 850° C with the total reduction in thickness being not less than 30%. By applying this secondary rolling step to the steel plate of the invention, the grain size of the steel plate is refined and a homogeneous micro-structure is obtained, because austenization at low temperature just above the $Ac_3$ transformation point produces fine austenite grains. In addition, the fact that the calcium addition in the present invention steel improves low temperature toughness essentially required for the arctic grade line pipe materials brings about an unexpected synergistic effect on the low temperature toughness in combination with the two step controlled rolling, which results in a homogeneous and fine micro-structure of the steel plate.

The present invention will be further explained in conjunction with some working examples of the present invention. It is to be noted that the examples shown hereinafter are mere embodiments of the invention and that the scope of the invention is not unduly limited thereto.

EXAMPLE

Steel plates of the present invention of a calcium-containing 1% Ni-steel were evaluated with respect to its mechanical properties in comparison with those of a calcium-free steel and a conventional 3.5% Ni-steel.

Table 1 shows the chemical composition of each of the steels subjected to experiments.

Table 1

| Steel | C | Si | Mn | P | S | Ni | Nb | V | Sol. Al | Ca | Remarks |
|---|---|---|---|---|---|---|---|---|---|---|---|
| A | 0.06 | 0.26 | 1.44 | 0.020 | 0.004 | 1.01 | 0.03 | 0.09 | 0.06 | 0.003 | present invention |
| B | 0.07 | 0.27 | 1.56 | 0.008 | 0.005 | 1.04 | 0.03 | 0.03 | 0.07 | — | comparative |
| C | 0.06 | 0.26 | 0.56 | 0.006 | 0.007 | 3.62 | — | — | 0.04 | — | conventional |
| D | 0.08 | 0.15 | 1.35 | 0.020 | 0.04 | 1.81 | 0.03 | — | 0.07 | 0.004 | present invention |
| E | 0.07 | 0.17 | 1.28 | 0.018 | 0.04 | 1.79 | 0.03 | — | 0.03 | — | comparative |
| F | 0.03 | 0.16 | 1.37 | 0.017 | 0.03 | 1.45 | 0.03 | 0.07 | 0.06 | 0.004 | present invention |
| G | 0.04 | 0.17 | 1.39 | 0.019 | 0.04 | 1.35 | 0.03 | 0.07 | 0.03 | — | comparative |

Specimens were prepared in accordance with the following manufacturing processes. Table 2 summarizes the conditions.

Table 2

| | | | | Rolling conditions | | | | | | | |
|---|---|---|---|---|---|---|---|---|---|---|---|
| | | | | Primary rolling | | Secondary rolling | | | | | |
| Steel | Steel Plate | Manufacturing Furnace | Final Slab thickness (mm) | Slab temp. (° C) | Slab thickness (mm) | Slab temp. (° C) | Roll thickness (mm) | Working | Finish-Quench-temp. (° C) | Tempering (° C) | ing (° C) |
| A | as-rolled plate | converter | 25.4 | 1250 | 250 | 980 | 70 | 800° C/ 50 mm | 700 | — | — |

Table 2-continued

| Steel | Steel Plate | Manufacturing Furnace | Final thickness (mm) | Rolling conditions: Primary rolling: Slab thickness temp. (° C) | Slab thickness (mm) | Secondary rolling: Slab temp. (° C) | Slab thickness (mm) | Rolling working | Finish-Quenching temp. (° C) | Tempering (° C) | ing (° C) |
|---|---|---|---|---|---|---|---|---|---|---|---|
| B | as-rolled plate | electric furnace | 25.4 | 1250 | 250 | 980 | 70 | 780° C/ 50 mm | 695 | — | — |
| C | Q. T. plate | electric furnace | 25.4 | 1250 | 250 | 980 | 70 | — | 900 | 600 | |
| D | as-rolled plate | converter | 10 | 1250 | 150 | 980 | 40 | 800° C/ 20 mm | 700 | — | — |
| E | as-rolled plate | converter | 10 | 1250 | 150 | 980 | 40 | 800° C/ 20 mm | 700 | — | — |
| F | as-rolled plate | converter | 15 | 1250 | 200 | 980 | 50 | 780° C/ 30 mm | 700 | — | — |
| G | as-rolled plate | converter | 15 | 1250 | 200 | 980 | 50 | 780° C/ 30 mm | 700 | — | — |

Results of the experiments are summarized in Table 3.

Table 3

| Steel | Y.S. (kg/mm²) | T.S. (kg/mm²) | El (%) | Y.R. (%) | Base material: VE-62 (kg$^{-m}$) | S.A. (%) | DWTT (%) | Heat affected zone VE-62 |
|---|---|---|---|---|---|---|---|---|
| A | 45.1 | 62.5 | 43.9 | 72.1 | 24.2 | 100 | 100 | 11.5 |
| B | 47.3 | 72.4 | 38.0 | 65.4 | 8.2 | 100 | 100 | 3.3 |
| C | 45.0 | 59.8 | 32.0 | 75.0 | 29.6 | 100 | 100 | 14.0 |
| D | 48.8 | 54.5 | 39.0 | 90 | 15.2* | 100 | 100 | 7.8** |
| E | 49.3 | 55.4 | 38.1 | 89 | 3.8* | 100 | 100 | 2.1** |
| F | 49.4 | 54.3 | 41.9 | 91 | 22.1* | 100 | 100 | 14.8*** |
| G | 49.1 | 54.5 | 38.2 | 90 | 4.5* | 100 | 100 | 2.8*** |

*VE-100
**VE-70
***VE-60
NOTE:
Y.S.: yield stength
T.S.: tensile strength
El: elongation
Y.R.: yield ratio
VE-60, -62, -70, -100: absorbed energy in the cross-direction at −60° C, −62° C, −70° C and −100° C, respectively, with Charpy Impact Test
S.A.: shear area
DWTT: ductile crack at −62° C with the Batialles DWTT It is apparent from the foregoing that the present invention successfully provides a steel plate having the same or improved mechanical properties in comparison to the conventional heat-treated steel plate without applying any special heat treatment and that the steel plate of the present invention may be used in an as-rolled state. It is recognized that the calcium addition brings about remarkable improvement in low temperature toughness on both the base material and the heat-affected zone.

One of the commercial advantages of the present invention is that the cost of the steel plate is less due to the reduction of the nickel content. Another advantage is that the present invention provides at a lower manufacturing cost an as-rolled steel plate having improved low temperature toughness, which may be used as the arctic grade line pipe material.

What is claimed is:

1. An as-rolled steel plate having improved low temperature toughness, which consists essentially of:

C: 0.03 – 0.55% by weight
Si: 0.02 – 0.50% by weight
Mn: 0.30 – 2.00% by weight
P: not greater than 0.025% by weight
S: not greater than 0.010% by weight
Ni: 0.8 – 2.0% by weight
Ca: 0.0005 – 0.004% by weight
Nb: 0 – 0.05% by weight
V: 0 – 0.10% by weight
Sol. Al: not greater than 0.080% by weight
Calcium/sulfur weight ratio: 0.05 – 1.50 said amounts of Ca and Ni serving to reduce the formation of bainite phase during low temperature rolling and making it possible for use of said plate as a pipe line material in the as-rolled state Fe: balance.

2. An as-rolled steel plate having improved low temperature toughness which consists essentially of:

C: 0.03 – 0.55% by weight
Si: 0.02 – 0.50% by weight
Mn: 0.30 – 2.00% by weight
P: not greater than 0.025% by weight
S: not greater than 0.010% by weight
Ni: 0.8 – 2.0% by weight
Ca: 0.0005 – 0.0040% by weight
Nb: 0 – 0.05% by weight
V: 0 – 0.10% by weight
Sol. Al: not greater than 0.080% by weight
Calcium/sulfur weight ratio: 0.05 – 1.50
Fe: balance and which is manufactured through a two step controlled rolling comprising the steps of: applying a primary rolling step by heating the steel to a temperature higher than 1000° C; rough rolling the heated steel to obtain a steel plate of a suitable intermediate thickness; reheating the rough rolled steel plate to a temperature of 800° – 1000° C; and applying a secondary rolling step by finish rolling the reheated steel plate within the temperature range of 680° – 850° C and with the total reduction in thickness being not less than 30% on the basis of the steel plate thickness when said finishing rolling is started.

3. An as-rolled steel plate as defined in claim 2, in which the reheating temperature of the secondary step rolling is from 900° to 1000° C; and the secondary step rolling is carried out within a temperature range of from 700° to 800° C.

4. An as-rolled steel plate as defined in claim 1, wherein Ca is 0.003% by weight.

5. An as-rolled steel plate as defined in claim 1, wherein Ca is 0.004% by weight.

6. An as-rolled steel plate as defined in claim 2, wherein Ca is 0.003% by weight.

7. As as-rolled steel plate as defined in claim 2, wherein Ca is 0.004% by weight.

* * * * *